United States Patent [19]

Aprea et al.

[11] 4,406,407

[45] Sep. 27, 1983

[54] HIGH FLOW LOW ENERGY SOLID CONE SPRAY NOZZLE

[75] Inventors: George F. Aprea, Dedham; Werner P. Pohle, Lynn, both of Mass.

[73] Assignee: Wm. Steinen Mfg. Co., Parsippnay, N.J.

[21] Appl. No.: 322,169

[22] Filed: Nov. 17, 1981

[51] Int. Cl.[3] ..... B05B 1/34

[52] U.S. Cl. ..... 239/487

[58] Field of Search ..... 239/463, 486–491, 239/493, 494, 496, 497

[56] References Cited

U.S. PATENT DOCUMENTS 3,415,453 12/1968 Costa ..... 239/488 X

FOREIGN PATENT DOCUMENTS 1273406 9/1961 France ..... 239/497

12959 of 1887 United Kingdom ..... 239/493

759144 8/1980 U.S.S.R. ..... 239/487

*Primary Examiner*—Andres Kashnikow

[57] ABSTRACT

A center vane is disclosed for a solid cone spray nozzle in which four generally U-shaped channels are symmetrically disposed around the vane axis and are skewed so that a line along their bottoms forms a 30° angle to the vane axis. Specific parameters are stated for the vane geometry and for the geometry of the channels so that the vane will cause a solid spray cone of uniform distribution for a large range of volumetric flows, pressures and pipe diameters.

12 Claims, 11 Drawing Figures

FIG. 1.
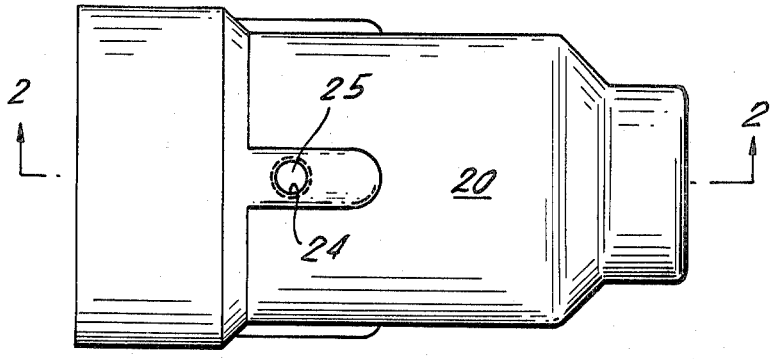
FIG. 2.
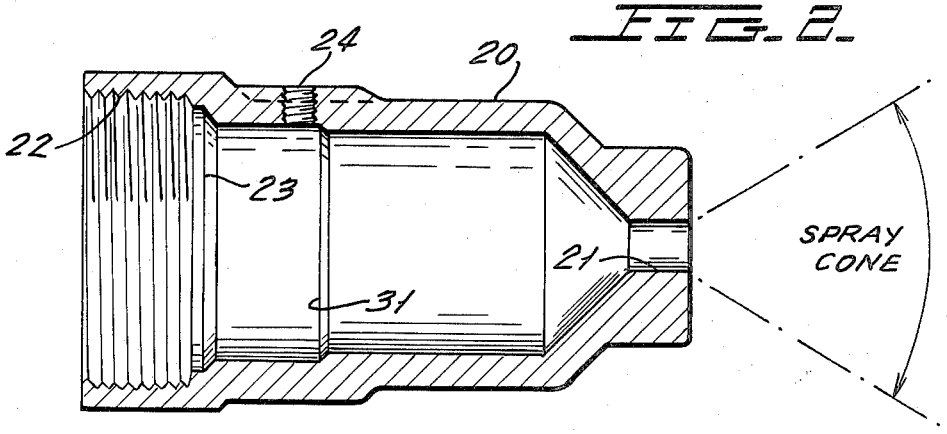
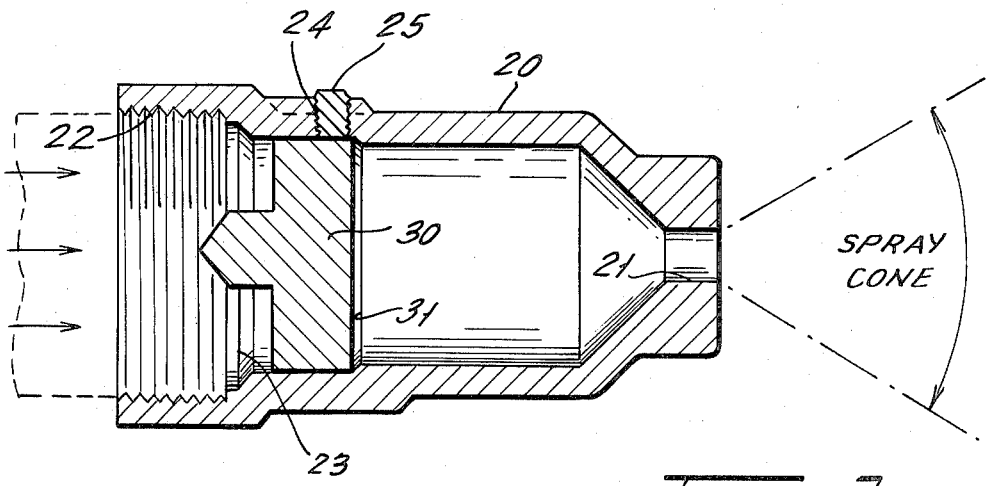
FIG. 3.

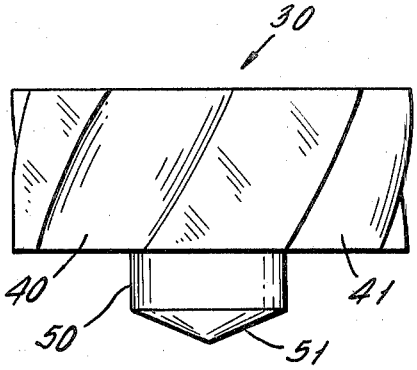
FIG. 6.
FIG. 5.
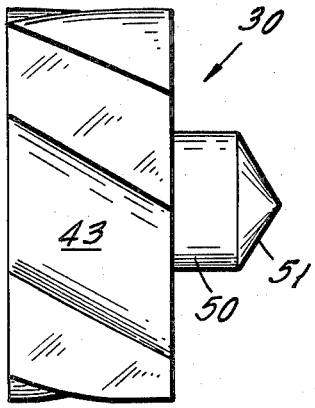
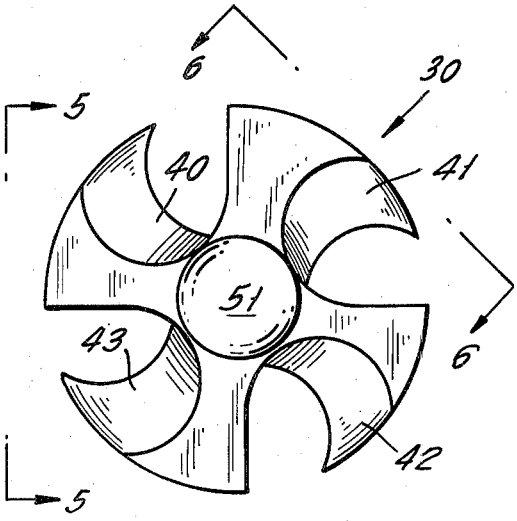
FIG. 4.
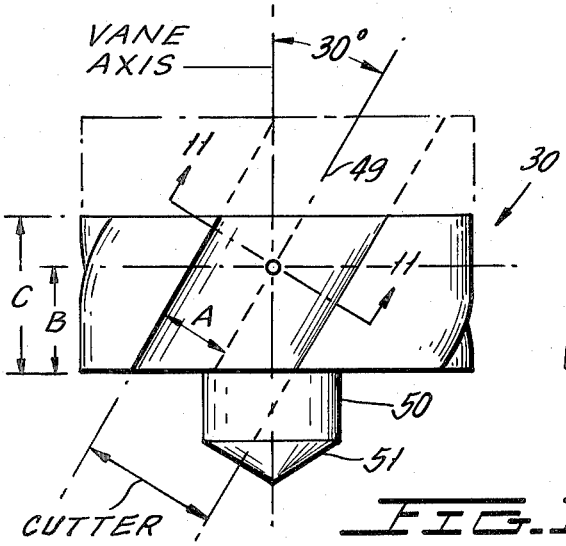
FIG. 10.
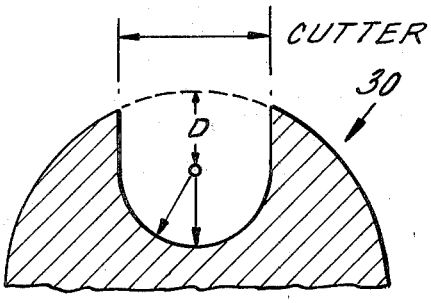
FIG. 11.

INPUT FACE

OUTPUT FACE

HIGH FLOW LOW ENERGY SOLID CONE SPRAY NOZZLE

BACKGROUND OF THE INVENTION

This invention relates to spray nozzles, and more specifically relates to a novel center vane for a straight-through solid cone spray type of nozzle.

Spray nozzles for forming solid spray cones are well known and are shown, for example, in U.S. Pat. No. 3,104,829 to Wahlin, U.S. Pat. No. 3,146,674 to Wahlin and 3,275,248 to O'Brien et al. Solid-spray solid cone nozzles are also commercially available from the Wm. Steinen Mfg. Co. of Parsippany, New Jersey, the assignee of the present application.

Solid cone nozzles commonly comprise a nozzle body having an input chamber which is connected to a fluid-conducting conduit of given diameter and flow capacity for fluids at a given pressure. A center vane is placed in the input chamber of the nozzle body and communicates between the input section and an axial discharge orifice of the nozzle body. The center vane commonly is provided with a plurality of slots which differ in number, angular configuration and size depending upon the desired end use and to maintain a solid spray cone in which the fluid flow per unit of time at any unit area across the cone is as uniform as possible relative to other unit areas across the cone.

In the past, the vane for the spray nozzle was custom-made for a particular application and to obtain a solid spray cone under given conditions of input pipe size, input pressure and volumetric fluid flow. It was not possible to simply change the scale of a given vane design when going from one input pipe size to another or from one input pressure to another because the resulting spray pattern would no longer be uniform and generally would become hollow or otherwise unsuitable. Thus a new vane design was required for each set of new pressure, volumetric flow and pipe diameter parameters. These vane designs are time-consuming since they are generally reached only after considerable trial and error methods and the cost of the resulting nozzle is substantially increased.

Parameters of the vane design which can be changed include the vane thickness, changes in the number of slots and their location, changes in the angular relationship of the slot to the axis of the vane, and changes in the cross-sectional geometry of the openings through the vane. For example, in the past, when the flow rate was increased, the vane design would be commonly modified by increasing the number of slots through the vane and/or by increasing slot width. Care had to be taken, however, since, if the slots became too wide or too numerous, fluid distribution over the area of the spray cone was poor. Similarly, if the number of slots became too great, the individual slot area was smaller and the slots were easily clogged by particulates carried in the fluid by other deposits from the fluid. Care also had to be taken during the design not to have the slots so large that the webs between the slots within the vane were structurally weakened to the point where they could easily fail during manufacture or in operation. Care also had to be taken to ensure against forming a hollow spray cone pattern.

BRIEF DESCRIPTION OF THE INVENTION

In accordance with the invention, a novel vane geometry has been produced which has been found to form a uniform solid cone spray for a wide range of pipe diameters, volumetric and input fluid pressures.

In particular, the vane geometry of the invention applies to pipes of any diameter, employing input pressures of from 1.0 p.s.i. to 150.0 p.s.i.

The novel design of the invention was reached through extensive experimentation and trial and error which revealed the following relationships which must be maintained in the vane design to retain a solid spray cone:

(1) The number of slots employed for the center vane is 3 or 4. Each slot has a generally U shape.

Each slot has a circular bottom which has a diameter equal to the spacing between the parallel walls of the slot. The slot is formed by a conventional cutter tool with a domed bottom.

(2) The slots are placed at a 30° angle to the axis of the vane, where the 30° angle is measured between the axis of the vane and a line extending along the center of the bottom of each slot, which line is in a plane which contains the axis of the slot.

(3) The cutter, or slot width, of each slot equals one-third plus or minus 10% of the outer diameter of the vane.

(4) The vane thickness measured along the vane axis is one-half, plus or minus 10% of the outer diameter of the vane.

(5) Each slot is not symmetrically located relative to the axis of the vane but, instead, extends along the width of the vane such that the inlet opening area of the vane is less than the outlet opening of the vane. This is accomplished by having the slot arranged so that a plane parallel to the slot walls and extending through the center of the slot bottom intersects the axis of the vane at an axial distance B along the vane which is equal within plus or minus 10% to the product of one-half the slot width and cotangent 30°; e.g. $B=\frac{1}{2}$ cutter (cot 30°) or $\pm 10\%$.

(6) The depth of each slot at the axial distance B defined above in item (4) along the axis of the vane is $0.36\pm 5\%$ times the vane diameter. Thus the depth at location B is about 9% greater than $\frac{1}{3}$ the diameter of the vane plus or minus 5% to ensure that the four discrete channels of water in respective vanes impinge on one another within the nozzle and before they reach the discharge nozzle.

The novel combination produces a swirling motion or controlled turbulence of fluid as it flows through the vane and before entering the discharge nozzle. When the liquid is discharged through the nozzle as a spray, the spray forms a solid cone having a very uniform distribution throughout the transverse cross-sectional area of the cone. When pipe diameter is changed, the vane diameter is proportionally changed and the above geometrical relationships for the four openings through the vane are maintained and the same desired uniform solid spray cone will still be produced. Similarly, when input fluid pressure or fluid flow rate is changed for the same or for different pipe diameters, the novel solid cone configuration of uniform distribution is maintained.

The novel vane structure of the invention can be made from any desired material including metals and plastics. A typical metal is steel. A typical plastic is polyvinyl chloride.

The conduit to which the cone nozzle is connected can be of any desired material and may be of metal such as steel or plastic such as polyvinyl chloride. In the case of plastic input conduits, the nozzle structure employed preferably has an input boss of conical shape extending from its input face. The conical boss preferably has a solid cone angle of about 60° to the axis of the vane. The boss has a diameter which is tangent to the bottoms of the four slots which are symmetrically disposed about the input face of the vane.

The reason for the boss is as follows: the nozzle body which receives the novel vane has an interior thread to receive the conduit. This thread is dimensioned so that the inner diameter of a steel pipe will be the same as the outer diameter of the vane to form a smooth transition for fluid flow into the vane. Plastic pipes which connect to the same interior thread in the nozzle body have a greater wall thickness than an equivalent metal pipe. Therefore, the inner diameter of the plastic pipe is less than the outer diameter of the vane. The purpose of the boss, particularly when plastic pipe is used rather than steel pipe, is to redirect the fluid stream into possible areas of low pressure created at the shoulder formed at the end of the thicker plastic pipe within the nozzle body.

BRIEF DESCRIPTION OF THE DRAWINGS

FIG. 1 is a plan view of a nozzle body which may employ the vane of the present invention.

FIG. 2 is a cross-sectional view of FIG. 1 taken across the section lines 2—2 in FIG. 1.

FIG. 3 is a cross-sectional view similar to that of FIG. 2 but shows a nozzle vane constructed in accordance with the principles of the present invention.

FIG. 4 is an elevational view of the nozzle vane of the present invention.

FIG. 5 is a view of FIG. 4 as seen from the line 5—5 in FIG. 4.

FIG. 6 is a view of FIG. 4 as seen from the line 6—6 in FIG. 4.

FIG. 10 is a view similar to that of FIG. 5 and identifies the key parameters which are controlled in accordance with the present invention.

FIG. 11 is a cross-sectional view of FIG. 10 taken across the section lines 11—11 in FIG. 10, and illustrates the shape of a channel at the location along the length of the channel where the legs of the U-shaped channel are of identical lengths.

DETAILED DESCRIPTION OF THE DRAWINGS

Figure 9:
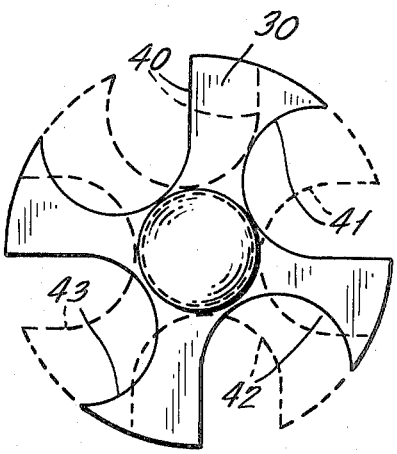
FIG. 9 illustrates the shape of the input face channel ends (shown in solid line) superimposed upon the shape of the channel ends in the output face (shown in dotted lines).

Referring first to FIGS. 1, 2 and 3, there is shown a typical spray nozzle body 20 which may be a cast iron member which has been appropriately machined to contain an output orifice 21 in its output end and pipe-receiving threads 22 in its inlet end. The pipe-receiving threads 22 are adapted to receive any suitable fluid conduit which has male threads to cooperate with threads 22. The conduits received by threads 22 may be of metal or plastic. Body 20 has a tapped opening 24 therein which receives a set screw 25 which is used to fix a center vane 30 in place and against locating shoulder 31. If desired, however, the vane 30 can be force-fit in body 20 to eliminate set screw 25. The structure of center vane 30 is the subject of this invention and will be described in connection with FIGS. 4 through 11.

The purpose of the assembly is to produce a solid spray cone as schematically shown by the dotted lines in FIGS. 2 and 3. This spray cone is intended to have a distribution over its entire area which is relatively uniform. The center vane 30, which causes a twirling and turbulent action of the fluid which passes through openings in the vane 30, has a very substantial influence on the uniformity of distribution of spray over the area of the cone. This uniformity is usually disturbed when there are changes in the volumetric flow of fluid into body 20 and through the vane 30 and is also disturbed by changes in the pressure of the fluid at the input side of body 20 and by changes in the diameter of the conduits and thus the nozzle body 20.

The novel vane of the invention has been found to produce a very uniform distribution of spray throughout the cone angle within ranges, for example, of 20 solid degrees to 140 solid degrees of cone angle; for pressure variations of 2 p.s.i. to 150 p.s.i. of the input fluid; and mass flows, depending on orifice and pipe sizes and pressures, for example, 1 gallon per minute to 15,000 gallons per minute at 10 p.s.i.; and for input pipe diameters of $\frac{1}{8}$ inch to 24 inches. Note that larger nozzles should be used at the lower pressures of the above ranges.

The novel center vane 30 is shown in FIGS. 4, 5 and 6. It consists of a main body which can be of steel or other metal, ceramic, silicon plastics, such as polyvinyl chloride and the like. The outer diameter of the center vane 30 will be closely matched to the inner diameter of the body 20 within which it must fit, as shown in FIG. 3.

The center vane is provided with four skewed channels 40 to 43 which are rotationally symmetric, around the vane axis and with respect to one another as will be later described. Channels or slots 40 to 43 are rotated by 90° from one another around the axis of vane 30.

The input face side of center vane 30 also has a boss 50 extending therefrom, which boss has a conical end portion 51. The boss 50 has a diameter such that it is tangent to each of the channels 40 through 43 which surround it.

In order to cause the nozzle 30 to retain the characteristics of a solid, uniform spray cone for varying input fluid pressures, varying volumetric flow and varying diameters, the following parameters were analyzed and the following critical values were discovered:

(1) NUMBERS OF SLOTS

It was found critical that only three or four slots be used which are of U-shaped configuration. Three or four slots were found to be ideal for the center vane since fewer (one or two) larger area slots reduces the effect of distribution of water, and thus reduces the ability of the center vane to swirl water to form the uniform distribution within a solid spray cone. A larger (five or more) smaller area slots was disadvantageous since they have smaller areas which are more likely to become clogged and are difficult to manufacture. Thus, the use of three or four slots is of critical significance to the design of the novel center vane.

(2) SLOT GEOMETRY

A slot geometry was selected which employs the generally U-shaped slot with a rounded bottom. The width of the slots is made equal to ⅓ the diameter of the center vane plus or minus 10%. This slot width is shown in FIG. 10 and is labeled "CUTTER" which is the term used to define this dimension since it is the diameter of the cutting tool which is employed to cut the slot. The slots have a circular bottom which has a radius equal to ½ the cutter dimension. The rounded bottom for the slot increases the flow area for the slots without making the webs between the slots so thin that they might not have the mechanical strength needed to withstand breakage during manufacture and use. Note that other geometries, such as the conventional square bottom slot, tends to reduce web thicknesses particularly at the bottom of adjacent slots.

(3) SLOT DEPTH

Figure 7:
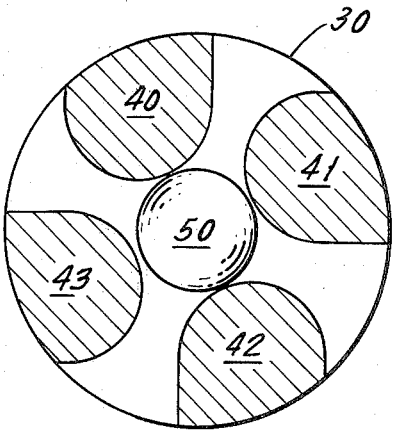
FIG. 7 schematically illustrates the channel openings in the input face end of the center vane of FIGS. 4, 5 and 6.
Figure 8:
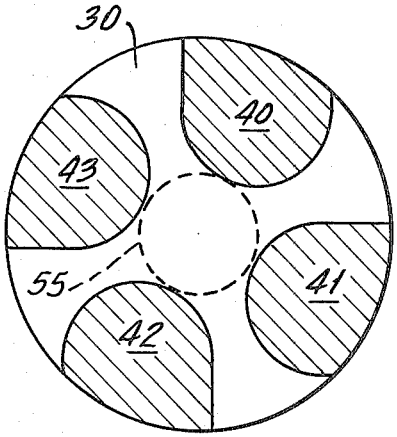
FIG. 8 illustrates the channel openings at the output face of the center vane of FIGS. 4, 5 and 6.

Because of the skew angle of the slot to be described, the shape of the slot changes as it progresses across the width of the vane. Thus as shown in FIGS. 7, 8 and 9, the shape of slot 40, for example, changes from one in which the left-hand side of the slot is shorter than the right-hand side of the slot at one face, whereas, at the opposite face, the relative lengths of the slot walls reverse so that the left-hand side is longer than the right-hand side. The same is true of the other slots 41, 42 and 43. A point is reached as the slot traverses through the thickness of the vane where the two sides of the U-shaped slots have an identical height. This occurs at the axial location B, shown in FIG. 10. If a cross-section is taken through any of the slots in a plane which is perpendicular to the vane axis and which intersects the vane axis at point B, such as the section 11—11 in FIG. 10, the slot will have the symmetric configuration shown in FIG. 11.

The slot depth D of FIG. 11 is measured at the axial distance B from the input face of the vane and along the vane axis. It has been found that this depth D should preferably be equal to ⅓ the diameter of the vane plus 9% of that value, e.g. 0.36 times the diameter of the vane. This should be held to a tolerance of about ±5%.

It has been found that, when this geometric relationship is used in combination with the preceding parameters and those which are to be described, the production of a solid spray is ensured for differing diameters, flows and pressures. This is, in part, because it ensures that the streams of fluid from the parallel channels will impinge on one another before reaching the discharge nozzle, thus ensuring the necessary turbulence and twirl to cause the solid spray cone.

It was found that if the depth D at the point B in FIG. 11 were only ⅓ the diameter of the vane, a hollow spray resulted with changes in pipe diameter. It was further found that when the depth was made greater than 0.36±5% times the diameter of the vane, the spray distribution was modified with changes in pipe diameter so that it became very heavy in the center of the cone and lighter toward the outside of the cone. However, by adding the additional critical 9% to the depth, a uniform conical spray distribution was obtained.

(4) VANE THICKNESS

The total vane thickness C, shown in FIG. 10, has been found preferably to be 0.5 times the diameter of the vane ±10% when used with the other parameters which are disclosed herein. When a greater thickness is used, the spray cone which is ultimately produced becomes hollow. Note that the total thickness of the vane is interrelated to the critical dimension B as will be later described.

(5) SLOT ANGLE

The angle of any of the slots 40 to 43 relative to the vane axis is 30° as measured between a line such as the dotted line 49 in FIG. 10 extending along the bottom of any of the vanes and the vane axis. More specifically, the line 49 is disposed in a plane which is parallel to the vane axis, and that the 30° measurement is made between the line 49 and a projection of the vane axis line on that same plane.

It has been found that the use of a 30° angle as defined above when taken in connection with all of the other parameters herein will give exactly the proper amount of rotational energy to fluid passing through the vane regardless of the mass flow of the fluid, its pressure and the diameter of the input conduits to retain a solid spray cone.

(6) THE EFFECTIVE LOCATION OF THE PLANE OF SYMMETRY FOR THE SLOTS

As pointed out previously, each of the slots 40 through 43 has symmetric or equal length sides at distance B along the length of the vane as measured from the input face of the vane. The distance B, when taken in connection with the other parameters given herein, should be equal within ±10% to the product of ½ the cutter dimension and the cotangent of 30°. That is to say, dimension B equals 0.87±10% times the cutter. By adhering to this dimensional relationship in combination with the other parameters described herein previously and particularly the 30° angle to the vane axis and the vane thickness, it is ensured that the channel discharge openings will be slightly larger than the input openings (FIGS. 7, 8 and 9) to ensure a uniform distribution throughout a solid cone of fluid which is produced.

It will be noted in FIG. 8 that the channels 40 to 43 at the output face each define tangent points to the dotted line circle 55. The circle 55 has a radius smaller than that of the radius of boss 50 since the channels 40 to 43 at the output face are closer to a diametric line through the vane than is the case of the channels at the input of FIG. 7.

As was previously described, vane 30 can be either plastic or metal or other materials. When the conduit connected to the threads 22 is also of metal and its inner diameter closely matches the inner diameter of housing 20 and thus the outer diameter of vane 30, no boss is needed on the vane. However, when plastic pipe is employed and connected to threads 20, the plastic pipe inner diameter may be smaller than the outer diameter of vane 30 so that there is a flow discontinuity at the point where the conduit ends and the vane surface begins. To ensure smooth, laminar flow of fluid around the discontinuity, it is useful to use boss 50 having a conical end 51 on the input face of the vane. The structure of the boss is such that its outer diameter is tangent to the base of each of channels 40 to 43. The surface of the conical projection 51 forms a solid angle with the axis of the vane of about 60° to cause flow diversion of the stream of fluid coming from the conduit attached to member 20 toward the channels or openings 40 to 43 and directs them around any discontinuity formed by a conduit which has a diameter smaller than the diameter of vane 30.

It was found that the boss 50 and its conical projection 51 do not interfere with the operation of the vane when used with metal pipe or with pipe having the same inner diameter as the outer diameter of the vane so that it has been expedient to employ the boss and its conical projection on all vanes.

As previously pointed out, the novel design of the present invention permits the use of the same geometry for a wide range of pipe sizes and for a wide range of pressures and volumetric flows. There follows a table showing the parameters of a vane design for pipe sizes varying from ¼ inch internal diameter to 8 inches internal diameter. Note that the vane can be used in pipes smaller than ¼ inch internal diameter and larger than 8 inch internal diameter while retaining the solid spray cone. The following table gives, in inches, the following parameters:

the cutter dimension;

Dimension A which is ½ the cutter as shown in FIG. 10 and represents the radius of the cutter tool employed to form the channel in the vane;

Dimension B which is described in FIG. 10 and is the effective center point through which all channels extend and is the point of symmetry for the channels;

Dimension C which is the vane thickness shown in FIG. 10; and

Dimension D which is the channel depth shown in FIG. 11.

| PIPE SIZE (Inches) | CUTTER | A | B | C | D |
|---|---|---|---|---|---|
| ¼ | .083 | .041 | .071 | .125 | .090 |
| ⅜ | .125 | .062 | .108 | .187 | .136 |
| ½ | .166 | .083 | .143 | .250 | .181 |
| ¾ | .250 | .125 | .216 | .385 | .272 |
| 1 | .333 | .166 | .287 | .500 | .363 |
| 1¼ | .416 | .208 | .360 | .625 | .453 |
| 1½ | .500 | .250 | .433 | .750 | .545 |
| 2 | .666 | .333 | .577 | 1.000 | .726 |
| 2½ | .833 | .416 | .721 | 1.250 | .908 |
| 3 | 1.000 | .500 | .866 | 1.500 | 1.090 |
| 3½ | 1.166 | .583 | 1.010 | 1.625 | 1.271 |
| 4 | 1.333 | .666 | 1.154 | 2.000 | 1.453 |
| 5 | 1.666 | .833 | 1.440 | 2.500 | 1.816 |
| 6 | 2.000 | 1.000 | 1.732 | 2.000 | 2.180 |
| 8 | 2.666 | 1.333 | 2.309 | 4.000 | 2.906 |

Each of the parameters was calculated on the basis of the relationships given above and apply to a vane employing four slots having the 30° angle shown in FIG. 10.

Although the present invention has been described in connection with a preferred embodiment thereof, many variations and modifications will now become apparent to those skilled in the art. It is preferred, therefore, that the present invention be limited not by the specific disclosure contained herein, but only by the appended claims.

What is claimed is:

1. A center vane for a straight-through pipe solid cone nozzle in which a single geometry produces a uniform spray distribution in a solid cone regardless of differences in fluid pressure, volumetric flow of fluid and pipe diameter; said center vane comprising a cylindrical body which is rotationally symmetric about a central axis and has spaced, parallel input and output faces which are perpendicular to said axis; said center vane having a circular outer periphery which has a diameter substantially equal to the internal diameter of said straight-through pipe; said vane having one of three or four symmetrically disposed slots extending into its said outer periphery; each of said symmetrically disposed slots having generally identical U-shaped configurations which have spaced, flat, parallel walls extending from said vane periphery to respective rounded bottoms; said spaced, flat, parallel walls spaced from one another by a cutter dimension equal to about one-third said vane diameter; the walls of each of said slots being symmetrically displaced from one another around said central axis of said vane; each of said slots being disposed at an angle to said vane axis, thereby to tend to twirl fluid around said vane axis; each of said slots having a smaller area at said input face and thereby the upstream face of said vane than at said output face and thereby the downstream face of said vane; the spaced walls of each of said slots having identical heights only in one respective plane perpendicular to respective ones of said slots; each of said one planes intersecting said vane axis at a distance B from said input face wherein the distance B equals the product of one-half the slot width of any of said slots and the cotangent of said angle between said slots and said vane axis.

2. The center vane of claim 1, wherein said angle between said slots and said vane axis is 30° and wherein said distance B is about 0.087 times the width of any of said slots.

3. The center vane of claim 1, wherein said vane has a width equal to about 0.5 times said vane diameter.

4. The center vane of claim 2, wherein said vane has a width equal to about 0.5 times said vane diameter.

5. The center vane of claim 1, wherein said rounded bottoms of said slots have respective radii equal to one-half the width of said slot.

6. The center vane of claim 2, wherein said rounded bottoms of said slots have respective radii equal to one-half the width of said slot.

7. The center vane of claim 3, wherein said rounded bottoms of said slots have respective radii equal to one-half the width of said slot.

8. The center vane of claim 4, wherein said rounded bottoms of said slots have respective radii equal to one-half the width of said slot.

9. The center vane of claim 1, 2, 3, 4, 5, 6, 7 or 8, in which each of said slots has a depth at said distance B along the axis of said center vane of about 0.36 times said diameter of said vane.

10. The center vane of claim 1, which further includes a central, circular boss extending from the center of said input face which is coaxial with said vane axis; the outer periphery of said boss being tangent to the respective bottoms of each of said slots.

11. The center vane of claim 9, which further includes a central, circular boss extending from the center of said input face which is coaxial with said vane axis; the outer periphery of said boss being tangent to the respective bottoms of each of said slots.

12. The center vane of claim 10, wherein the upstream surface of said boss is a tapered cone which forms a solid angle of 60° to said vane axis.

* * * * *